US005231929A

United States Patent [19]

Theurer et al.

[11] Patent Number: 5,231,929

[45] Date of Patent: Aug. 3, 1993

[54] BALLAST CLEANING MACHINE WITH VIBRATOR ATTACHED TO TRACK LIFTING UNIT FOR VIBRATING THE UNIT TRANSVERSELY WHEN REPLACING TRACK ON THE BALLAST

[75] Inventors: Josef Theurer, Vienna; Herbert Wörgötter, Gallneukirchen, both of Austria

[73] Assignee: Franz Plasser Bahnbaumaschinen-Industriegesellschaft m.b.H., Vienna, Austria

[21] Appl. No.: 806,870

[22] Filed: Dec. 12, 1991

[30] Foreign Application Priority Data

Feb. 12, 1991 [AT] Austria ..... A300/91

[51] Int. Cl.[5] ..... E01B 27/04

[52] U.S. Cl. ..... 104/2; 104/7.2; 104/12; 171/16

[58] Field of Search ..... 104/2, 7.1, 7.2, 12; 171/16; 37/104

[56] References Cited

U.S. PATENT DOCUMENTS

| | | | |
|---|---|---|---|
| 3,685,589 | 8/1972 | Plasser et al. | 171/16 |
| 3,957,000 | 5/1976 | Plasser et al. | 171/16 |
| 4,046,078 | 9/1977 | Theurer | 104/7.2 |
| 4,432,284 | 2/1984 | Theurer et al. | 107/2 X |
| 4,881,467 | 11/1989 | Theurer | 104/7.2 |
| 4,893,565 | 1/1990 | Theurer et al. | 104/7.2 |
| 4,947,757 | 8/1990 | Theurer et al. | 104/7.2 |
| 4,953,467 | 9/1990 | Theurer et al. | 104/7.1 |

*Primary Examiner*—Robert J. Oberleitner
*Assistant Examiner*—S. Joseph Morano
*Attorney, Agent, or Firm*—Collard & Roe

[57] ABSTRACT

A mobile ballast cleaning machine comprises a machine frame, undercarriages supporting the machine frame for mobility on the track, an excavating chain mounted on the machine frame and arranged to excavate the ballast to expose the subgrade, a ballast screening installation arranged to receive the excavated ballast from the excavating chain and to clean the received ballast, a conveyor arrangement for conveying the cleaned ballast for distribution on the exposed subgrade, a power-actuated, vertically and transversely adjustable track lifting device mounted on the machine frame, and a vibrator connected to the track lifting device, the vibrator being arranged to generate horizontal oscillations extending transversely to the longitudinal direction.

5 Claims, 1 Drawing Sheet

BALLAST CLEANING MACHINE WITH VIBRATOR ATTACHED TO TRACK LIFTING UNIT FOR VIBRATING THE UNIT TRANSVERSELY WHEN REPLACING TRACK ON THE BALLAST

BACKGROUND OF THE INVENTION

1. Field of the Invention

The present invention relates to a mobile ballast cleaning machine for continuously receiving ballast from a ballast bed supported on a subgrade and supporting a track having two rails, and for cleaning the received ballast, which comprises a machine frame extending in a longitudinal direction along the track, undercarriages supporting the machine frame for mobility on the track in an operating direction, an excavating chain mounted on the machine frame and arranged to excavate the ballast to expose the subgrade, a ballast screening installation arranged to receive the excavated ballast from the excavating chain and to clean the received ballast, a conveyor arrangement for conveying the cleaned ballast for distribution on the exposed subgrade, and a power-actuated, vertically and transversely adjustable track lifting device mounted on the machine frame.

2. Description of the Prior Art

Such ballast cleaning machines are very well known, as exemplified by U.S. Pat. No. 3,685,589, dated Aug. 22, 1972, which discloses a ballast cleaning machine in which the machine frame is supported on the track at each end by undercarriages and an excavating chain is vertically and laterally adjustably mounted on the machine frame centrally between the undercarriages for excavating dirty and encrusted ballast and convey the excavated ballast upwardly to a vibratory ballast screening installation for cleaning the ballast. The waste component coming from the screening installation is conveyed by two independently operated conveyor bands to the respective ends of the machine frame while a further conveyor conveys the cleaned ballast component from the screening installation to a discharge end at the exposed subgrade immediately behind a transverse course of the excavating chain extending under the track. At this location, a power-actuated, vertically and laterally adjustable track lifting device on the machine frame lifts the track. Immediately behind this cleaned ballast discharge point, a second track lifting device is arranged on the machine frame to raise the track sufficiently to enable a vibratory ballast compactor to be inserted for engaging the surface of the cleaned ballast for smoothing and compacting the cleaned ballast discharged on the subgrade. A cleaned ballast discharge chute is disposed at the rear of the ballast screening installation for distributing a portion of the cleaned ballast in the cribs. While the cleaned ballast bed can be compacted with this machine, the disposition of the surface compactor requires a relatively high raising of the track.

SUMMARY OF THE INVENTION

It is the primary object of this invention to improve a ballast cleaning machine of the first-described type so that the distributed cleaned ballast may be compacted sufficiently to support the track immediately after the cleaning operation for relatively high-speed traffic.

In a mobile ballast cleaning machine for continuously receiving ballast from a ballast bed supported on a subgrade and supporting a track having two rails, and for cleaning the received ballast, which comprises a machine frame extending in a longitudinal direction along the track, undercarriages supporting the machine frame for mobility on the track in an operating direction, an excavating chain mounted on the machine frame and arranged to excavate the ballast to expose the subgrade, a ballast screening installation arranged to receive the excavated ballast from the excavating chain and to clean the received ballast, a conveyor arrangement for conveying the cleaned ballast for distribution on the exposed subgrade, and a power-actuated, vertically and transversely adjustable track lifting device mounted on the machine frame, the above and other objects are accomplished according to this invention by connecting a vibrator to the track lifting device, the vibrator being arranged to generate horizontal oscillations extending transversely to the longitudinal direction.

This novel arrangement for the first time enables the redistributed cleaned ballast to be compacted immediately by applying a vertical load and vibrations to the track resting on the cleaned ballast bed. In this way, the unavoidably high initial settling of the track on the cleaned ballast bed is partially anticipated and compensated, which also increases the resistance of the track to transverse displacement on an otherwise relatively loose ballast bed. This compaction of the cleaned ballast bed has the added advantage that any high points of the track, due to irregular discharge and distribution of the cleaned ballast, can be smoothed by operating the vertical adjustment drive of the vibrating track lifting device. This will fix the track immediately after the cleaned ballast has been distributed under the track in a position which enables train traffic at reasonably high speed to proceed thereover.

The excavating chain comprises a transverse course extending transversely and under the track, and if the track lifting device is arranged between the transverse excavating chain course and an undercarriage supporting a rear end of the machine frame, as seen in the operating direction, the track position may be changed and the track may be vibrated without any problems caused by imparting unacceptable tensions to the track rails.

According to a preferred feature, the machine further comprises a track level reference system on the machine frame, the reference system including a level pickup controlling the track lifting device for control of the track level. This makes it possible to combine the distribution of the cleaned ballast under the track with a settling and leveling of the track on a compacted ballast bed so that the same is able to sustain train traffic at higher speeds than could be used heretofore after a ballast renewal operation.

With a track lifting device comprising two power-actuated lifting rollers associated with each track rail and engageable with a field side of the associated track rail and a flanged wheel running on the associated rail centrally between the two lifting rollers, the track lifting device will be very firmly connected to the track rails so that the lifting and vibrating forces may be smoothly transmitted to the track without interference with the continuous forward movement of the machine.

According to another preferred feature, two track lifting devices are linked to the machine frame adjacent each other in the longitudinal direction, a respective vibrator being connected to each track lifting device. In this way, the vibrating zone is doubled in length, which improves the degree of ballast compaction and produces an effective compaction even of a relatively deep ballast bed without necessitating a reduction of the forward speed of the machine.

The conveyor arrangement preferably comprises two conveyor bands, each having a discharge end for discharging the cleaned ballast immediately ahead of the track lifting device in the operating direction. This prevents an excessive discharge of cleaned ballast, which would reduce the freedom of movement of the track necessary for track position correction, on the one hand, while providing sufficient ballast for support of the track, on the other hand. It is advantageous to arrange a cleaned ballast distributing chute arranged between the discharge end of each conveyor band and the track lifting device. In this way, the cleaned ballast discharge may be concentrated at the points where the ties and rails intersect for support of the track on the ballast, and a ballast accumulation in the center of the track, which could cause the ties to tilt after they have settled, may be avoided. The chutes are preferably connected to the track lifting device so that they may be vertically adjusted between a lowered operating position and a raised rest position with the track lifting device, without requiring any additional structure. Furthermore, if each conveyor band is pivotal about a vertical axis at a forward end of the conveyor band opposite to the discharge end thereof, a ballast accumulation at the track lifting device may be avoided in case of a sudden stoppage of the forward movement of the machine. All that needs to be done is a pivoting of the conveyor band so that its discharge end projects over the track shoulder.

In accordance with yet another preferred feature, the machine further comprises a tamping head arranged at each side of the machine behind the track lifting device in the operating direction, each tamping head comprising ballast tamping tools equipped with tamping plates extending in the longitudinal direction and drive means for vertically adjusting the tamping tools and for pivoting the tamping tools about an axis extending in the longitudinal direction. The operation of the tamping tools will increase the resistance of the track to lateral displacement after the track has been leveled and settled in the ballast bed by the vibrating track lifting device so that the resultant tension in the rails will not cause a repositioning of the track after the ballast renewal operation. Each tamping head preferably comprises an array of four tamping tools aligned adjacent each other in the longitudinal direction. In this way, a relatively large area of the ballast at the ends of the ties is tamped.

BRIEF DESCRIPTION OF THE DRAWING

The above and other objects, advantages and features of the present invention will become more apparent from the following de'ailed description of certain now preferred embodiments thereof, taken in conjunction with the somewhat schematic accompanying drawing wherein.

DETAILED DESCRIPTION OF PREFERRED EMBODIMENTS

Figure 1:
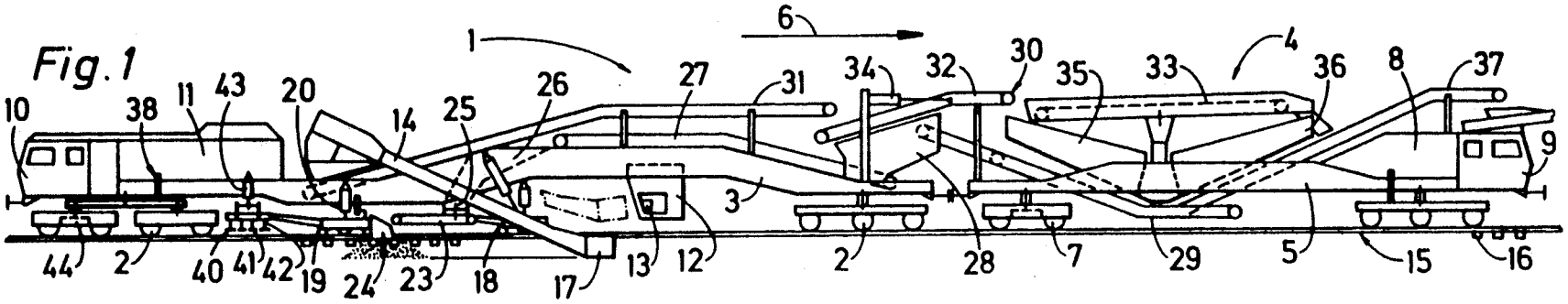
FIG. 1 is a side elevational view of a mobile ballast cleaning machine incorporating the vibratory track lifting device of this invention.
Figure 2:
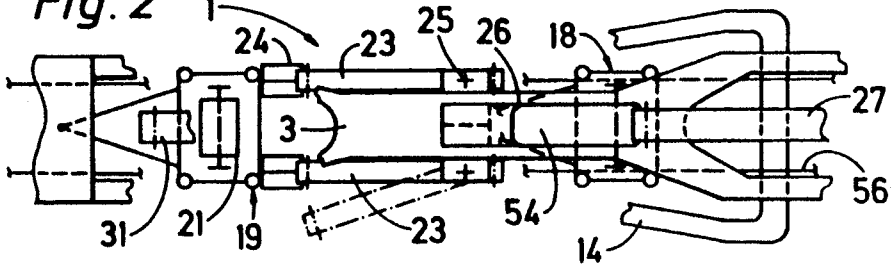
FIG. 2 is an enlarged and fragmentary top view showing the track lifting device of the machine of FIG. 1.

Referring now to the drawing and first to FIGS. 1 and 2, there is shown mobile ballast cleaning machine 1 for continuously receiving ballast from a ballast bed supported on a subgrade and supporting a track 15 having two rails 56, 56 fastened to ties 16, and for cleaning the received ballast. The machine comprises first machine frame 3 extending in a longitudinal direction along the track, undercarriages 2, 2 supporting machine frame 3 for mobility on track 15 in an operating direction indicated by arrow 6, and excavating chain 14 mounted on the machine frame and arranged to excavate the ballast to expose the subgrade. Ballast cleaning machine 1 further comprises second machine frame 5 detachably coupled to machine frame 3 and preceding the first machine frame in the operating direction, the second machine frame being supported on track 15 by undercarriages 7, 7. The front end of machine 1 carries engineer's cab 9 and power plant 8 mounted on second machine frame 5 while the rear end of the ballast cleaning machine carries engineer's cab 10 and power plant 11 mounted on first machine frame 3. The power plants provide energy to the various operating drives of the machine. First machine frame 3 has an upwardly recessed center portion carrying operator's cab 12 which houses control panel 13.

Figure 3:
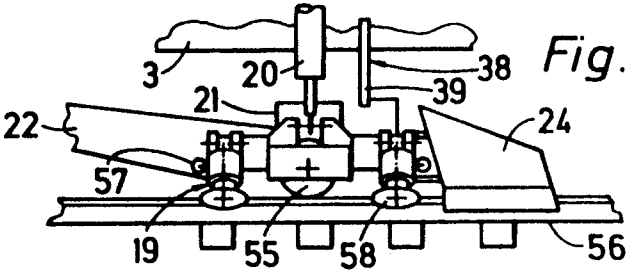
FIG. 3 is an enlarged and fragmentary side view showing the track lifting device equipped with a vibrator.

Excavating chain 14 is a conventional, power-driven endless ballast excavating chain vertically adjustably linked to machine frame 3 and comprising a transverse course 17 within view, and rearwardly, of operator's cab 12, which excavating chain course extends transversely to, and under, track 15 to excavate the ballast and expose the subgrade. Power-actuated, vertically and transversely adjustable track lifting device 18 is mounted on machine frame 3 immediately behind transverse excavating chain course 17. A further track lifting device 19 is mounted on machine frame 3 between transverse excavating chain course 17 and rear undercarriage 2, and drives 20 connect the track lifting device to the machine frame for vertically and laterally adjusting the track lifting device. Drives 20 are capable of imparting a vertical load to track lifting device 19 and to track 15 gripped thereby. The preferred track lifting device shown in FIG. 3 comprises two power-actuated lifting rollers 58, 58 associated with each track rail 56 and engageable with a field side of the associated track rail by pivoting drives 57, and a flanged wheel 55 running on the associated rail centrally between the two lifting rollers. As also illustrated in FIG. 3, hydraulically operated vibrator 21 (FIG. 3) is connected to track lifting device 19 to impart thereto horizontal oscillations extending transversely to track 15, and longitudinally extending carrier 22 links the track lifting device to machine frame 3 for movement therewith.

A ballast screening installation comprised of twin ballast screens 35, 36 is arranged on second machine frame 5 to receive the excavated ballast from excavating chain 14 and to clean the received ballast, and sequentially arranged ballast conveyor bands 29, 27 extend in the longitudinal direction to receive the cleaned ballast from the ballast screening installation and to convey it to chute 26. The two ballast screens have separate drives for independently vibrating the screens. Overhead conveyor unit 30 comprised of three successively arranged conveyor bands 31, 32, 33 conveys the encrusted ballast excavated by endless chain 14 to one and/or the other ballast cleaning screen 35, 36, and the vibratory screens separate the ballast into a cleaned ballast portion and rubble which is removed by conveyor unit 37. Central conveyor band 32 projects over machine frame 5 of car 5, which supports the screening installation, and is longitudinally displaceably and transversely pivotally mounted on machine frame 3, drives 34 being linked to conveyor band 32 for displacing and pivoting the same. Conveyor band 33 is mounted on car 5 above the screening installation. The cleaned ballast is conveyed by input conveyor band 29 into storage bin 28 whence it is conveyed to the discharge end of conveyor band 27. Chute 26 is arranged at excavating chain 14 and has a single input funnel 54 (FIG. 2) for receiving the cleaned ballast from the discharge end of ballast conveyor band 27 and has two outlet openings discharging the cleaned ballast from chute 26 onto respective conveyor bands 23 associated with each outlet opening for receiving the cleaned ballast from the outlet opening. Conveyor bands 23 discharge the cleaned ballast through ballast distributing chute 24 on the exposed subgrade immediately in front of track lifting device 19 in the operating direction. Conveyor bands 23 are transversely spaced from each other in a horizontal plane and respectively extend in the longitudinal direction above track rails 56, and each conveyor band is pivotal at its front end about vertical axis 25. Track lifting device 19 is arranged immediately rearwardly of the discharge ends of conveyor bands 23, and each cleaned ballast distributing chute 24 is affixed to the track lifting device. The arrangement of conveyor bands 23 and associated chutes 26 and 24 is more fully described and claimed in our concurrently filed U.S. patent application entitled "Ballast Cleaning Machine".

The vertical adjustment of excavating chain 14 and track lifting device 19 is controlled by reference system 38 forming part of ballast cleaning machine 1. The reference system comprises level measurement pickup 39 controlling the operation of track lifting device 19 so that the track level will be determined in response to the reference. This control forms no part of the invention and a level measuring system useful for the machine of the present invention has been described and claimed in U.S. Pat. No. 4,432,284, dated Feb. 21, 1984. It will, therefore, not be described herein.

A tamping head 40 is mounted on each side of the machine immediately preceding rear undercarriage 2 and each tamping head is equipped with vertically adjustable tamping tools 42 equipped with tamping plates 41 extending in a longitudinal direction and pivotal about an axis extending in the longitudinal direction. Drives 43 are connected to the tamping tools for vertically adjusting and pivoting the same. Drive 44 enables the machine to be continuously moved forward in the operating direction during the ballast excavating, cleaning and redistributing operation.

Figure 4:
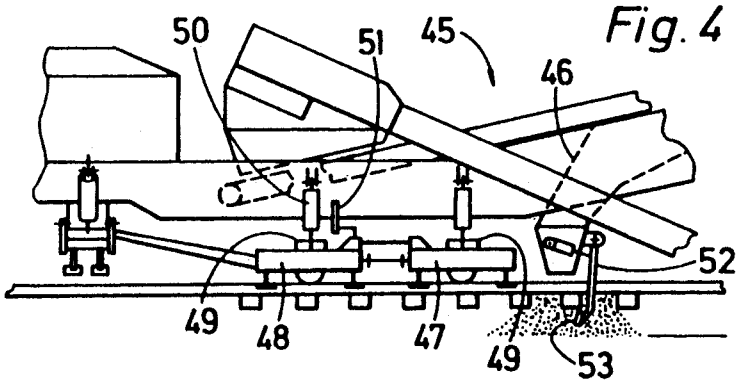
FIG. 4 is a like view showing another embodiment with two adjacent track lifting devices.

Ballast cleaning machine 45 partially illustrated in FIG. 4 embodies essentially the same structure and design as machine 1 shown in FIGS. 1-3, except that two successive track lifting devices 47, 48 are adjacently arranged immediately succeeding cleaned ballast distributing chute 46. Each track lifting device has its own vibrator 49, the two vibrators being connected by a drive shaft for synchronizing the horizontal and transversely extending vibrations they impart to the track lifting devices. A respective drive 50 connects each track lifting device to the machine frame for vertically adjusting the track lifting device. A level measurement pickup 51 of a reference system of the above-described type is associated with rear track lifting device 48. Ballast tamping device 52 is pivoted to chute 46 and may be pivoted by a suitable drive about a horizontal axis extending transversely to the track and parallel to the track ties. Tamping element 53 is mounted at the lower end of the tamping device which may be pivoted into a rest position extending above and parallel to the track during transit of the machine. By cyclically moving tamping element 53 back and forth as the cleaned ballast is distributed by chute 46 on the exposed subgrade, the ballast is moved under the ties.

Ballast cleaning machine 1 or 45 operates in the following manner:

While the machine continuously advances along track 15 in the operating direction indicated by arrow 6, endless excavating chain 14 is operated to excavate the dirty and encrusted ballast underneath the track to expose the subgrade, and the excavated ballast is conveyed by overhead conveyor arrangement 31, 32, 33 to vibratory ballast cleaning screens 35, 36 in which the dirt and rubble is separated from the cleaned ballast. The cleaned ballast is conveyed by input conveyor band 29 to storage bin 28 whence it is further conveyed by conveyor band 27 which discharges the cleaned ballast into chute 26. The cleaned ballast then falls through outlet openings of the chute onto conveyor bands 23 extending above each track rail 56. The conveyor bands convey the cleaned ballast to ballast distributing chutes 24 which distribute the cleaned ballast over the exposed subgrade. If the ballast cleaning machine is suddenly stopped for some reason, conveyor bands 23 may be pivoted by suitable drives about axes 35 to distribute the cleaned ballast on the track shoulder.

Immediately behind the cleaned ballast distributing devices in the operating direction, track lifting device 19 (or track lifting devices 47, 48) will continually impart horizontal, transversely extending oscillations to track 15 while, at the same time, lowering the track to a uniform level determined by level measurement pickup 39 (or 51) of reference system 38. The vibrating track lowered into the cleaned ballast bed by the force of drives 20 (or 50) will enhance the flow of the distributed ballast and will compact the same. The necessary vertical load required for the controlled lowering of track 15 is generated by hydraulic drives 20 (or 50) linking the track lifting device to machine frame 3. The track level controlled by track lifting device 19 is secured by the operation of the two tamping heads 40, which are transversely spaced from each other and whose tamping tools 42 at the opposite ends of the ties will tamp the cleaned ballast under the track. For this purpose, the tamping tools are immersed in the shoulder ballast and they are operated to shovel the lowest layer of the shoulder ballast up to the area adjacent the tie ends where the ballast is compacted by pressing it under the ties. The tamping tools are then slightly raised and are again pivoted laterally outwardly and into the lowest layer of the shoulder ballast in a cyclically repeated elliptical pivoting motion of tamping plates 41. This tamping of the cleaned ballast at the opposite ends of the ties will considerably improve the resistance of track 15 to transverse displacement.

What is claimed is:

1. A mobile ballast cleaning machine for continuously receiving ballast from a ballast bed supported on a subgrade and supporting a track having two rails, and for cleaning the received ballast, which comprises (a) a machine frame extending in a longitudinal direction along the track, (b) undercarriages supporting the machine frame for mobility on the track in an operating direction, (c) an excavating chain mounted on the machine frame and arranged to excavate the ballast to expose the subgrade, (d) a ballast screening installation arranged to receive the excavated ballast from the excavating chain and to clean the received ballast, (e) a conveyor arrangement for conveying the cleaned ballast for distribution on the exposed subgrade, (f) a power-actuated, vertically and transversely adjustable track lifting device mounted on the machine frame behind the excavating chain in the operating direction, the track lifting device comprising power actuated gripping rollers for gripping each track rail and (g) a vibrator connected to the track lifting device, the vibrator being arranged to generate horizontal oscillations on the track lifting device extending transversely to the longitudinal direction.

2. The ballast cleaning machine of claim 1, further comprising a track level reference system on the machine frame, the reference system including a level pickup controlling the track lifting device for control of the track level.

3. The ballast cleaning machine of claim 1, comprising two of said track lifting devices linked to the machine frame adjacent each other in the longitudinal direction, a respective one of the vibrators being connected to each track lifting device.

4. The ballast cleaning machine of claim 1, further comprising a tamping head arranged at each side of the machine behind the track lifting device in the operating direction, each tamping head comprising ballast tamping tools equipped with tamping plates extending in the longitudinal direction and drive means for vertically adjusting the tamping tools and for pivoting the tamping tools about an axis extending in the longitudinal direction.

5. The ballast cleaning machine of claim 4, wherein each tamping head comprises an array of four of said tamping tools aligned adjacent each other in the longitudinal direction.

* * * * *